United States Patent [19]

Crump et al.

[11] Patent Number: 4,771,801

[45] Date of Patent: Sep. 20, 1988

[54] PROTECTIVE COVER ASSEMBLY WITH REVERSE BUCKLING DISC

[75] Inventors: Joseph B. Crump; William K. Maddox, both of Duncan, Okla.

[73] Assignee: Halliburton Services, Duncan, Okla.

[21] Appl. No.: 10,235

[22] Filed: Feb. 2, 1987

[51] Int. Cl.[4] ..... F16K 17/40

[52] U.S. Cl. ..... 137/68.1; 210/89

[58] Field of Search ..... 137/68.1; 210/89 A

[56] References Cited

U.S. PATENT DOCUMENTS

| | | | |
|---|---|---|---|
| 2,370,870 | 3/1945 | McKeugue | 137/68.1 X |
| 3,216,611 | 11/1965 | Lechovallier | 137/68.1 X |
| 3,770,918 | 11/1973 | Fortmann | 137/68.1 X |
| 3,815,779 | 6/1974 | Ludwig | 220/89 A |
| 4,408,194 | 10/1983 | Thompson | 137/68.1 X |
| 4,498,606 | 2/1985 | DiRienzo | 137/68.1 X |
| 4,520,837 | 6/1985 | Cole | 137/68.1 |

*Primary Examiner*—A. Michael Chambers
*Assistant Examiner*—John C. Fox
*Attorney, Agent, or Firm*—James R. Duzan; Neal R. Kennedy

[57] ABSTRACT

A protective cover assembly for a fluid end of a plunger-type pump or other positive displacement pump. The protective cover assembly includes a cover adapted to fit in an open end of the fluid end of the pump. The cover comprises a convex or domed center portion adapted for buckling away from a plunger of the pump when pressure in the pump exceeds a predetermined level and further comprises an outer portion. A cover retainer is engageable with the open end of the fluid end of the pump and is adapted for clamping the outer portion of the cover to the fluid end. A seal is provided between the outer portion of the cover and the fluid end. The convex center portion of the cover has a convex surface generally facing the plunger, and the convex surface is preferably hemispherical. In one embodiment, the convex center portion has a substantially constant cross-sectional thickness, and in an alternate embodiment, the convex center portion has an enlarged section adapted for affecting a pressure level required for buckling the convex portion. A method of preventing overpressure in a fluid end of a plunger-type pump using the protective cover assembly is also disclosed.

7 Claims, 2 Drawing Sheets

PROTECTIVE COVER ASSEMBLY WITH REVERSE BUCKLING DISC

BACKGROUND OF THE INVENTION

1. Field Of The Invention

This invention relates to protective devices for positive displacement pumps, and more particularly, to a protective cover assembly having a reverse buckling disc which buckles rather than shears when subjected to excessive pressure.

2. Description Of The Prior Art

It is common practice in the petroleum industry to employ high pressure plunger-type pumps in a variety of field operations relating to oil and gas wells, such as cementing, acidizing, fracturing and others. An example of such a high pressure pump is the Halliburton Services HT-400 Horizontal Triplex Pump manufactured by Halliburton Services of Duncan, Okla. Such pumps commonly generate pressures in excess of 10,000 psi, and are on occasion subject to overpressuring for a variety of reasons. Several common causes of overpressure are blockage of a pump discharge line, the erroneous closure of a valve on the discharge side of the pump, or the phenomenon of "sandout".

Sandout may occur during a fracturing job, wherein the producing formation of the well is subjected to high pressures to "fracture" the producing strata. It is common in such fracturing operations to include a proppant, such as glass or ceramic beads, walnut shells, glass microspheres, sintered bauxite, or sand (hereinafter collectively and individually referred to as "sand") in the carrier fluid, so as to provide a means of maintaining the cracks in the fracturing producing formation open after the fracturing pressure is released. Present day fracturing operations often employ a foamed carrier fluid such as nitrogen or carbon dioxide as the gaseous phase of the foam, in order to lower the volume and cost of the chemicals required and in many cases to avoid a large hydrostatic force on a well formation, such as is often encountered in gas wells.

There has also recently been a marked tendency to load up the carrier liquid with as much sand as possible prior to foaming, in order to further lower fluid volume requirements and hence job costs to the customer. Such concentrations may reach and exceed sixteen pounds of sand per gallon of carrier fluid. These high sand concentrations impose severe performance demands on the blender, manifold and pump systems due to the erosive effect of the sand and the tendency of slugs of sand to collect in valves, elbows, and in the fluid ends of the high pressure pumps. A collection of sand in these areas is dependent upon a number of parameters, including gravity, fluid flow rate, rheological properties of the carrier fluid, physical properties of the sand, and the geometry of the system as a whole.

However, regardless of causation, the concentration of sand associated with the sandout in the fluid end of a high pressure pump can result in sudden overpressuring of the fluid end with resulting damage to one or more of the plunger, connecting rod, crankshaft, fluid end or other parts of the pump drive train. The overpressuring due to sandout is particularly destructive as the resulting force may be eccentrically applied to the plunger and fluid end, as a slug of sand often collects at the bottom of the plunger.

It has been well known in the art to attempt to alleviate this sandout problem with ball-type valves in the pumps. However, such valves are susceptible to clogging due to the sand content of the carrier liquid, and may also fail to reclose after the problem is corrected due to the presence of sand in the valve or the erosive effect of the sand laden carrier fluid.

Another solution to the overpressuring problem is disclosd in U.S. Pat. No. 4,508,133 to Hamid, assigned to the assignee of the present invention. This invention comprises a protective cover assembly including a substantially circular cover having a shear disc surrounded by an annular outer portion, mounted in a cylinder in the fluid end of the plunger-type high pressure pump. An arcuate boundary of reduced wall thickness lies between the shear disc and the outer portion of the cover. The cover is held in place by a retainer assembly which is secured to the fluid end, which retainer assembly includes a plug backed by an impact disc at the outer end of the retainer. When a predetermined force is generated by the plunger and the cylinder, the shear disc of the cover shears and is propelled outwardly against the plug, which in turn forces the impact disc against the edge of a circular recess in the outer end of the retainer, the recess being of lesser diameter than the impact disc. The impact disc, in shearing against the recess edge, safely dissipates the kinetic energy of the shear disc, while the pressure in the cylinder vents to the atmosphere, avoiding damage to the fluid end of the pump, the plunger, connecting rod, crankshaft, etc., as well as potential damage to the well head. However, the retainer employed with a protective cover is expensive to construct, and in order to refurbish a sheared cover and retainer assembly, a new impact disc as well as a new cover must be available. Moreover, the use of a destructible impact disc to absorb energy adds to the operating costs of the pump in which they are employed.

U.S. Pat. No. 4,520,837 to Cole et al., also assigned to the assignee of the present invention, discloses a protective cover with a shear disc essentially the same as in Hamid, but also includes a more simple, one-piece cover retainer inserted behind the protective cover. When the shear disc is subjected to a load in excess of the shear strength of the arcuate boundary thereon, the cover shears along the boundary and the shear disc is propelled outwardly by the pressure in the fluid end into the cover retainer, the interior of which is of substantially frustoconical configuration, with the base of the cone oriented substantially coaxially with respect to the shear disc. The kinetic energy of the shear disc is substantially dissipated by the contact of the periphery of the disc with the ever decreasing diameter inner wall of the retainer, which plastically deforms the shear disc. The fluid end of the pump, the plunger, connecting rod, crankshaft, etc., are saved from harm by the venting of the overpressure when the disc shears. After the cover retainer with the trapped shear disc and the sheared cover outer portion are removed from the fluid end of the pump, the sand is cleared from the fluid end (if sandout is the cause of the overpressure), a new protective cover is installed, the cover retainer resecured to the fluid end, the pump restarted and the fracturing operation recommenced.

While the apparatus of Cole et al. has advantages over the apparatus of Hamid, there are still a number of problems remaining. First of all, the shear disc is subjected to cyclic loading. This cyclic stress causes fatigue and premature failure of the disc around the thin arcuate wall may occur even at low pump pressures. Another problem is that the thin area around the arcuate portion does not leave much thickness for corrosion allowance, and thus may fail prematurely when corrosion is present. A further problem with the previous apparatus is that the shear disc is expensive to fabricate, and machining will invariably leave machine marks which act as stress risers and compound the fatigue problem already mentioned.

The present invention solves these problems by providing a protective cover assembly with a reverse buckling disc which has a convex surface exposed to the pressure in the pump and thus is loaded in compression only. This greatly improves fatigue life. The convex shape of the disc is easily stamped, thereby eliminating machining marks and the problems related therewith. Because there is no thin section, corrosion is not a great problem.

Another advantage of the present invention is that, under normal circumstances, no fluid is vented out of the pump because of the buckling action of the reverse buckling disc.

SUMMARY OF THE INVENTION

The protective cover assembly of the present invention is adapted for use in a fluid end of a plunger-type or other positive displacement pump and comprises a cover positionable in an outer end of the fluid end, the cover including buckling relief means for buckling in response to overpressure in the pump and thereby relieving the overpressure without venting fluid externally of the pump, and retainer means for retaining the cover in the outer end.

The buckling relief means is best characterized by a domed portion of the cover having a convex surface generally facing a plunger of the pump and adapted for buckling away from the plunger in response to pressure in the fluid end of the pump. Preferably, the convex surface is substantially hemispherical. In one embodiment, the domed portion has a substantially constant cross-sectional thickness. In another embodiment, the domed portion has an enlarged section adapted for affecting the pressure level required for buckling the domed portion.

The retainer means is characterized by a cover retainer engaged with the fluid end of the pump which clamps against an outer portion of the cover. The cover retainer has a substantially frustoconical inner wall for containing the buckling relief means and dissipating kinetic energy thereof in the event of rupture, rather than buckling, of the buckling relief means.

The protective cover assembly may also comprise sensing means for sensing buckling of the buckling relief means and interrupting power delivered to the pump in response to the buckling.

A sealing means is disposed between the outer portion of the cover and the fluid end. In one embodiment, the sealing means is characterized by an annular elastomeric seal.

By use of the protective cover assembly, a method is provided for preventing overpressure in a fluid end of a plunger-type pump which comprises the steps of providing an open end in the fluid end of the pump in communication with at least one cylinder of the pump, sealingly blocking the open end with a protective cover having a buckling disc portion, determining a maximum load on the buckling disc portion whereby the buckling disc portion buckles in response to a predetermined pressure level in the pump, and retaining the cover in the open end. The step of determining a maximum load on the buckling disc portion may comprise selecting an enlarged thickness of at least a portion of the buckling disc portion. Additional steps comprise positioning sensing means adjacent the buckling disc portion for sensing buckling thereof and interrupting power to the pump in response to the sensing of the buckling. The method may further comprise containing the reverse buckling disc portion and dissipating the kinetic energy thereof in the event of rupture of the buckling disc portion.

An important object of the present invention is to provide a protective cover assembly having buckling relief means therein for buckling in response to the overpressure in a plunger-type pump or other positive displacement pump, the buckling thereby relieving the overpressure in the pump without venting fluid externally thereof.

An additional object of the invention is to provide a protective cover assembly with a cover having a domed center portion with a convex surface generally facing a plunger of the pump and adapted for buckling away from the plunger in response to a predetermined pressure in the fluid end of the pump.

A further object of the invention is to provide a cover having a domed center portion with an enlarged section for affecting a pressure level required for buckling the domed portion.

Still another object of the invention is to provide a method of preventing overpressure in the fluid end of a plunger-type pump without venting fluid from the pump.

Additional objects and advantages of the invention will become apparent as the following detailed description of the preferred embodiments is read in conjunction with the drawings which illustrate such preferred embodiment.

DETAILED DESCRIPTION OF THE PREFERRED EMBODIMENT

Figure 1:
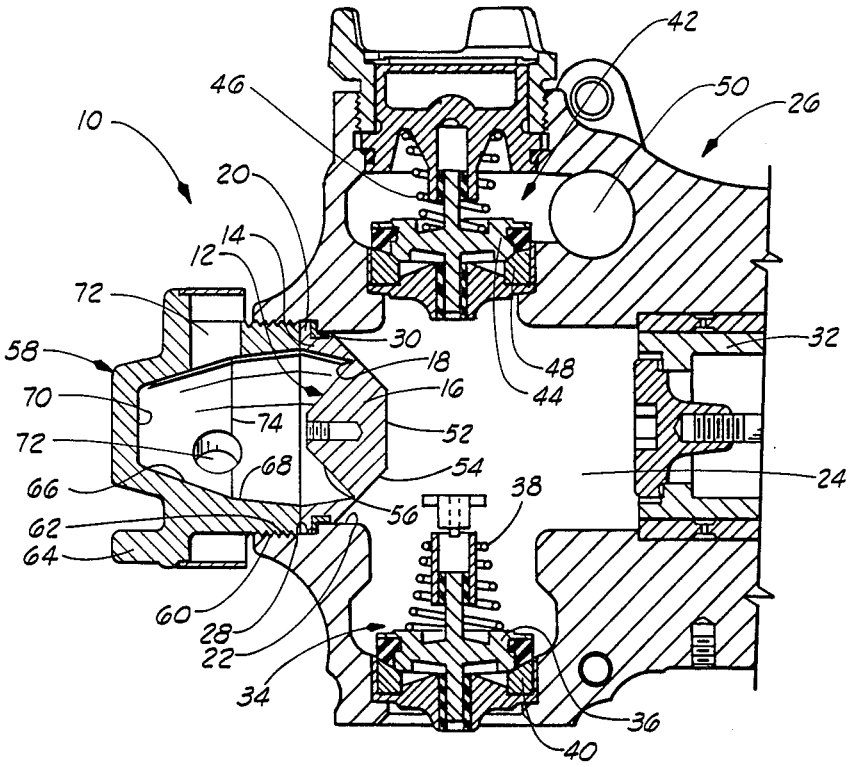
FIG. 1 PRIOR ART
FIG. 1 is a horizontal section elevation of a portion of the fluid end of a plunger type pump employing a prior art protective cover assembly.

Referring now to the drawings, and more particularly to FIG. 1, a prior art type of protective cover assembly for positive displacement pumps is shown, and generally designated by the numeral 10. Prior art cover assembly 10 is substantially the same as that disclosed in U.S. Pat. No. 4,520,837 to Cole et al., assigned to the assignee of the present invention.

Cover assembly 10 includes a shallow cup-shaped cover 12 having a cylindrical outer portion 14 and a circular inner shear disc 16 with an arcuate boundary 18 of reduced wall thickness therebetween. Outer portion 14 includes an outwardly extending annular flange 20.

Cover 12 fits into open, outer end 22 of a cylinder 24 of fluid end 26 of a pump. The pump typically has a plurality of cylinders, such as the HT-400 Horizontal Triplex Pump manufactured by Halliburton Services of Duncan, Okla. There is one such cover 12 at the outer end of each cylinder 28 in the pump. In the operating position of cover 12 shown in FIG. 1, flange 20 extends into annular fluid end recess 28 adjacent outer end 22 of cylinder 24. Flange 20 is of greater diameter than outer end 22 but less than that of fluid end recess 28. An elastomeric seal 30 is disposed between cover 12 and outer end 22 and adjacent flange 20 and recess 28.

Cover 12 is positioned substantially coaxially with pump plunger 32 in cylinder 24. As shown in FIG. 1, installed at the bottom of cylinder 24 is an inlet or suction valve assembly 34, including inlet valve 36 which is biased by a spring 38 against a valve seat 40. At the top of cylinder 24 is an outlet or discharge valve assembly 42, including an outlet valve 44 which is biased by a spring 46 against a valve seat 48. In normal pump operation, fluid enters cylinder 24 through suction valve assembly 34 by the withdrawal of plunger 32 from cylinder 24, after which the fluid in cylinder 24 is raised in pressure by the advance of plunger 32 toward cover 12 in cylinder 24, the fluid then exiting from cylinder 24 into outlet passage 50 through discharge valve assembly 42. As this type of plunger pump and its operation are well known in the art, no further explanation will be given thereof, nor of the drive means for plunger 32, such drive means being also well known in the art.

The inner end of cover 12 which generally faces plunger 32 has a flat circular end face 52 surrounded by an oblique annular face 54. The opposite side of cover 12 includes a shallow cone portion 56 which extends away from cylinder 24.

Cover 12 is maintained in fluid end 26 by the insertion of cup-shaped one-piece cover retainer 58 into fluid end 26 and the making up of threads 60 on cover retainer 58 to threads 62 in fluid end 26 adjacent fluid end recess 28. Thus, flange 20 on cover 12 is clamped between cover retainer 58 and fluid end 26, with elastomeric seal 30 providing a fluid-tight seal between cover 12 and fluid end 26.

Cover retainer 58 further includes hammer lugs 64 on its exterior, by which the cover retainer may be tightly threaded to fluid end 26 by a sledgehammer, as is commonly used in petroleum industry field operations.

The interior of cover retainer 58 is of substantially frustoconical configuration, being defined by two contiguous frustoconical inner walls 66 and 68. Wall 66 has a greater angular taper than wall 68. A flat end portion or "bottom" 70 is located at the outermost end of conical wall 66 and generally faces cover 12. At least one aperture 72 extends from the exterior of cover retainer 58 to the interior thereof.

When the pressure in cylinder 24 exerts a force exceeding the design shear load of arcuate boundary 18 of cover 12, shear disc 16 is sheared from outer portion 14 and is propelled outwardly toward cover retainer 58.

Inner wall 68 is of greater inner diameter throughout its length than the diameter of shear disc 16 (as defined by the diameter of arcuate boundary 18) and therefore will not substantially interfere with the movement of shear disc 16, even if the shearing along arcuate boundary 18 is eccentric and movement of shear disc 16 is not entirely coaxial. However, at line 74 where conical wall 66 begins, the diameters of conical wall 66 and shear disc 16 are substantially the same. Thereafter, the diameter of conical wall 66 rapidly reduces so that the periphery of sheared shear disc 16 will contact inner wall 66 and will plastically deform as it progresses to the end of inner wall 66 at bottom 70 of cover retainer 58 whereby the kinetic energy of shear disc 16 is safely dissipated. Aperture 72 in cover retainer 58 permits safe venting of the pump pressure to the atmosphere by redirecting the pressurized fluid outwardly.

In order to prepare fluid end 26 of the pump for service after an overpressure, each cover retainer 58 which has vented is backed off from fluid end 26, and both shear disc 16 and outer portion 14 of protective cover 12 are discarded. A new, unsheared cover 12 is easily installed as already described.

If the overpressure in cylinder 24 is caused by sand-out, the shearing of shear disc 16 may be eccentric, and the shear disc may not strike conical inner wall 66 of cover retainer 58 squarely. However, the force will still be transmitted to conical inner wall 66, and may in fact be less than in an instance of uniform shear, as part of the pressure may be vented to the atmosphere as shear disc 16 shears rather than acting to propel the shear disc outwardly.

While prior art cover assembly 10 has worked well in many situations, there are problems associated therewith which can cause premature shearing. One such problem is low fatigue life because cover 12 cycles alternately in compression and tension as plunger 32 reciprocates in fluid end 26. This cyclic stress causes fatigue along arcuate boundary 18 and may result in premature shearing of shear disc 16, even at low pressures. The thickness of cover 12 along arcuate boundary 18 must be thin so that shear disc 16 shears as desired, and this does not allow much corrosion allowance. Further, cover 12 must be machined to its final shape, and this machining leaves machine marks which act as stress risers, thus increasing the stresses adjacent arcuate boundary 18 and adding to the fatigue problem.

Another problem with prior art cover assembly 10 is that venting fluid externally of the pump is not particularly desirable.

Figure 2:
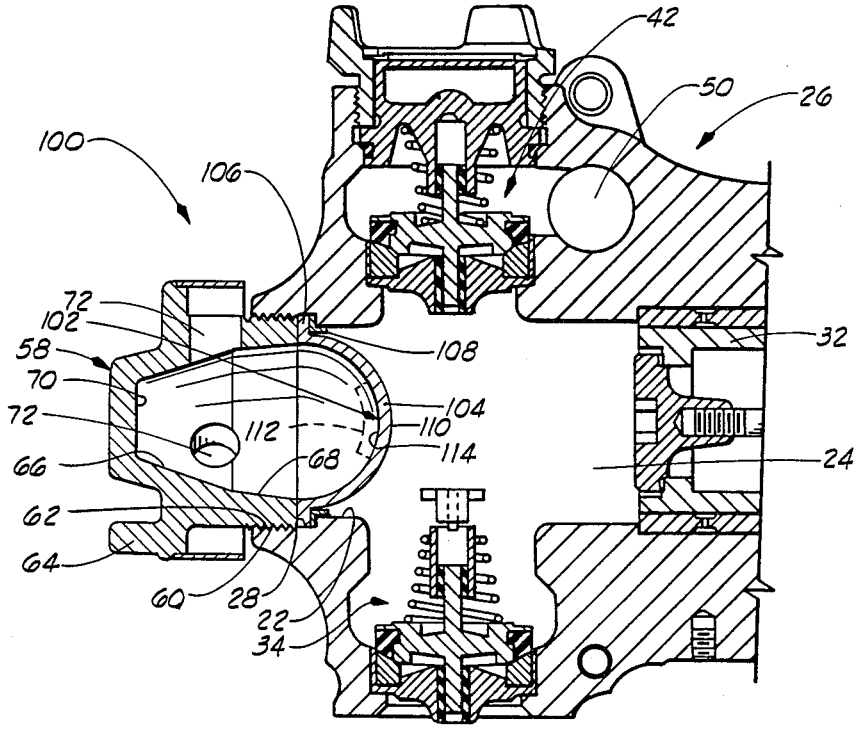
FIG. 2 is a view similar to FIG. 1, but illustrating the protective cover assembly of the present invention with a first embodiment of a reverse buckling disc.

Referring now to FIG. 2, the protective cover assembly of the present invention is shown and generally designated by the numeral 100, installed in fluid end 26 of a pump. As will be seen, the design of protective cover assembly 100 eliminates all of the problems associated with prior art cover assembly 10. Fluid end 26 as used with the present invention is substantially identical to that used with prior art cover assembly 12 and includes cylinder 24, plunger 32, suction valve assembly 34, discharge valve assembly 42, and outlet passage 50 as hereinbefore described.

As shown in FIG. 2, protective cover assembly 100 includes a cover 102 having a convex or domed center portion 104 with an outer portion including an annular flange 106 extending outwardly therefrom. Annular flange 106 extends into fluid end recess 28 and is of greater diameter than outer end 22 but less than that of fluid end recess 28. A sealing means such as elastomeric seal 108 is disposed between cover 102 and outer end 22 and adjacent flange 106 and recess 28.

Domed portion 104 is of substantially constant thickness and has a convex surface 110 which generally faces plunger 32. Cover 102 is held in place by cover retainer 58 by the engagement of threads 60 on the cover retainer with threads 62 in fluid end 26 adjacent recess 28. Cover retainer 58 thus acts as a retainer means for retaining cover 102 in place in its operating position in substantially the same manner as cover retainer 58 holds cover 12 in place in the prior art apparatus already described. Cover retainer 58 is again tightened by hammering on lugs 64.

Domed portion 104 of cover 102 may be described as a reverse buckling disc 104. The term "reverse" denotes that convex surface 110 is exposed to fluid pressure in cylinder 24. Preferably, convex surface 110 is substantially hemispherical, the sphere, of course, being the strongest geometrical shape, although other convex curvilinear surfaces are also suitable. The term "buckling" implies that disc 104 is designed to fail by buckling rather than by shear. In other words, when the pressure in cylinder 24 exceeds the design load of reverse buckling disc 104, the disc acts as a buckling relief means, preferably buckling outwardly away from plunger 32, thus relieving the pressure. In this way, fluid is not normally vented from fluid end 26 upon overpressure. However, if the pressure is sufficiently high to rupture reverse buckling disc 104 or tear it away from flange 106, cover retainer 58 will catch and contain disc 104 in a manner similar to that described for the prior art apparatus. When this occurs, the kinetic energy due to the movement of disc 104 is dissipated by contact of the disc with conical inner walls 68 and 66. Fluid pressure is vented through aperture 72.

It will be seen by those skilled in the art that reverse buckling disc 104 is always in compression during reciprocation of plunger 32 in fluid end 26. Thus, the present invention has a greatly improved fatigue life over the prior art apparatus because of the absence of great cyclic stress. Further, the essentially constant thickness of reverse buckling disc 104, compared to the thin section of arcuate boundary 18 around shear disc 16 of cover 12 in the prior art device, gives added corrosion life.

The manufacturing problems associated with the prior art apparatus are also eliminated. The spherical shape of reverse buckling disc 104 of the preferred embodiment is easily formed by pressing a plate between a ball and die. In this way, no machine marks are present which again improves fatigue life. Even if reverse buckling disc 104 is not spherical, but of some other convex curvilinear configuration, it is also easily formed by a similar stamping process with no machining marks.

In addition, convex surface 110 should also help minimize turbulence during pumping, keeping the proppant suspended by providing streamlined flow paths around the surface of reverse buckling disc 104.

As an alternate feature, sensing means such as an electrical sensor or contact strip 112 can be attached to concave surface 114 of reverse buckling disc 104 and placed in electrical communication with the transmission or power source on the pump. When buckling disc 104 buckles due to overpressure in cylinder 24, the electrical connection is interrupted or an electrical signal is sent which can shift the transmission to neutral or shut down the power source, thus protecting the pump as well as the reverse buckling discs 104 in the other cylinders of the pump.

Figure 3:
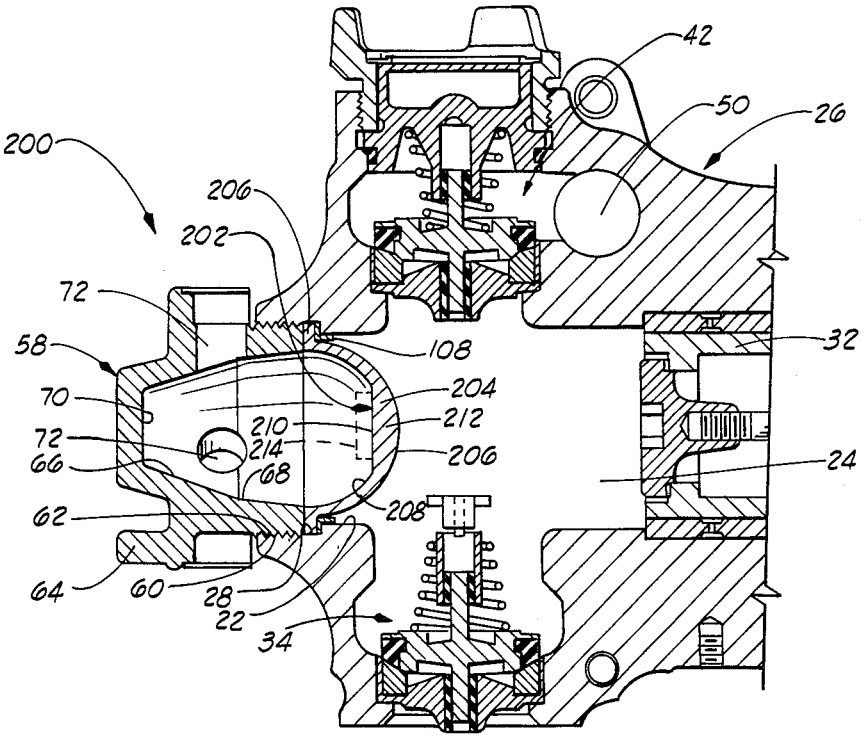
FIG. 3 is a view similar to FIG. 1 and illustrating an alternate embodiment of a reverse buckling disc.

Referring now to FIG. 3, an alternate embodiment of the protective cover assembly of the present invention is shown and generally designated by the numeral 200. Alternate cover assembly 200 includes a cover 202 with a convex or domed center portion 204, also referred to as reverse buckling disc 204, and having an outer portion including an annular flange 206 extending outwardly therefrom. Cover 202 is assembled with seal 108 and held in place by cover retainer 58 in a manner substantially identical to the first embodiment.

Reverse buckling disc 204 has a convex surface 206, again preferably hemispherical in configuration, which generally faces plunger 32. However, reverse buckling disc 204 is not of constant thickness. Instead, concave surface 208 of reverse buckling disc 204 is truncated by a substantially flat transverse surface 210, resulting in an enlarged center section 212 at approximately the center of reverse buckling disc 204. By selectively varying this thickness, the pressure in cylinder 24 required to buckle reverse buckling disc 204 may be varied. Thus, means are provided for selectively varying the failure pressure of the reverse buckling disc.

As with the first embodiment, a sensing means, such as electrical sensor or contact strip 214 may be attached to reverse buckling disc 204, for example, along flat surface 210, for sensing buckling and interrupting power to the pump in response to the buckling.

In addition to providing an enlarged section on the reverse buckling disc, other means of selectively varying the failure pressure include varying the strength of the material from which reverse buckling disc 102 or 202 is formed. Also, the wall thickness in reverse buckling disc 102 or 202 may be varied as desired to provide failure at the desired predetermined pressure in cylinder 24.

It can be seen, therefore, that the protective cover assembly with reverse buckling disc of the present invention is well adapted to carry out the ends and advantages mentioned as well as those inherent therein. While numerous changes in the construction and arrangement of parts may be made by those skilled in the art, all such changes are encompassed within the scope and spirit of the appended claims.

What is claimed is:

1. A protective cover assembly for a plunger-type pump having a fluid end which includes a cylinder with a reciprocating plunger therein, said plunger creating a cyclic pressure differential for pumping a fluid therethrough, said assembly comprising:

a cover positionable in an outer end of said fluid end, said cover including buckling relief means of a hemispherical configuration having a convex portion disposed towards said plunger, for buckling in a direction away from said plunger without rupturing when a pressure within said cylinder acting on said cover exceeds a first predetermined level, thereby relieving said pressure without venting fluid externally of said pump, wherein the hemispherical configuration increases the useful life of said relief means by minimizing the effects of stress exerted thereon by said cyclic pressure differential, and by providing a streamlined flow path for said fluid within said fluid end; and retainer means, having an aperture therethrough, for retaining said cover in said outer end, wherein said said aperture externally vents said fluid after said relief means is ruptured due to pressure within said cylinder exceeding a second predetermined level which is greater than said first predetermined level.

2. The assembly of claim 1 wherein said relief means has a substantially constant thickness.

3. The assembly of claim 1 further comprising sensing means for sensing buckling of said buckling relief means and interrupting power delivered to said pump.

4. The assembly of claim 1 wherein said retainer means is characterized by a cover retainer engaged with said fluid end and having a frustoconical inner wall for containing said buckling relief means and dissipating kinetic energy thereof in the event of rupture of said buckling relief means.

5. The assembly of claim 1 further comprising sealing means disposed between said cover and said fluid end.

6. The assembly of claim 1 wherein said relief means has an enlarged section for setting said first predetermined pressure level and said second predetermined pressure level.

7. The assembly of claim 6 wherein:

said relief means has a concave surface on a side of said cover opposite said plunger; and said enlarged section is formed by a substantially flat surface truncating said concave surface.

* * * * *